US005096005A

United States Patent [19]

Ivie et al.

[11] Patent Number: 5,096,005

[45] Date of Patent: * Mar. 17, 1992

[54] HYDRAULIC ACTION FOR ROTARY DRILL BITS

[75] Inventors: Craig R. Ivie; David E. Pearce, both of Houston, Tex.

[73] Assignee: Camco International Inc.

[ * ] Notice: The portion of the term of this patent subsequent to Jul. 9, 2008 has been disclaimed.

[21] Appl. No.: 613,241

[22] Filed: Nov. 14, 1990

Related U.S. Application Data

[63] Continuation-in-part of Ser. No. 502,046, Mar. 30, 1990, Pat. No. 5,029,656, which is a continuation-in-part of Ser. No. 381,040, Jul. 17, 1989, Pat. No. 4,989,680.

[51] Int. Cl.[5] ..... E21B 10/18

[52] U.S. Cl. ..... 175/340; 175/339; 175/424

[58] Field of Search ..... 175/340, 339, 424, 353

[56] References Cited

U.S. PATENT DOCUMENTS

| | | | |
|---|---|---|---|
| 1,143,274 | 6/1915 | Hughes | 175/339 |
| 2,108,955 | 2/1938 | Zublin | 175/340 |
| 2,192,693 | 3/1940 | Payne . | |
| 2,873,092 | 2/1959 | Dwyer | 175/340 |
| 2,885,186 | 5/1959 | Hammer | 175/340 |
| 3,014,544 | 12/1961 | Steen | 175/340 |
| 3,084,751 | 4/1963 | Scarborough | 175/340 |
| 3,137,354 | 6/1964 | Crawford et al. | 175/340 |
| 3,144,087 | 8/1964 | Williams, Jr. | 175/339 |
| 3,618,682 | 11/1971 | Bennett | 175/65 |
| 4,154,312 | 5/1979 | Barnetche | 175/228 |
| 4,222,447 | 9/1980 | Cholet | 175/340 |
| 4,351,402 | 9/1982 | Gonzalez | 175/340 |
| 4,369,849 | 1/1983 | Parrish | 175/340 |
| 4,516,642 | 5/1985 | Childers et al. | 175/340 |
| 4,546,837 | 10/1985 | Childers et al. | 175/340 |
| 4,619,335 | 10/1986 | McCullough | 175/339 |
| 4,657,093 | 4/1987 | Schumacher | 175/353 |
| 4,673,045 | 6/1987 | McCullough | 175/339 |
| 4,741,406 | 5/1988 | Deane et al. | 175/340 |
| 4,848,476 | 7/1989 | Deane et al. | 175/340 |
| 4,886,131 | 12/1989 | Cholet et al. | 175/340 |

FOREIGN PATENT DOCUMENTS

| | | | |
|---|---|---|---|
| 36772 | 9/1981 | European Pat. Off. | 175/340 |
| WO9005830 | 3/1990 | PCT Int'l Appl. . | |
| 258972 | 4/1970 | U.S.S.R. . | |
| 344099 | 8/1972 | U.S.S.R. | 175/339 |
| 1104310 | 2/1968 | United Kingdom . | |

*Primary Examiner*—Hoang C. Dang

*Attorney, Agent, or Firm*—Dodge, Bush, Moseley & Riddle

[57] ABSTRACT

A rotary drill bit (10) has fluid discharge nozzles (36A, 36B, 36C) positioned between adjacent pairs of roller cutters (20A, 20B, 20C). A fluid discharge nozzle (36A) provides a stream of drilling fluid (44) directed toward an adjacent roller cutter (20A) and slanted toward the bore hole side wall away from a radial direction at a slant impact angle B for first impacting the side wall (34), and then sweeping in a high velocity stream along the corner surface (33) and inwardly across the bore hole bottom (32) at cutting element engagement locations (39).

25 Claims, 9 Drawing Sheets

HYDRAULIC ACTION FOR ROTARY DRILL BITS

CROSS REFERENCE TO RELATED APPLICATIONS

This application is a continuation-in-part of pending application Ser. No. 502,046 filed Mar. 30, 1990, now the U.S. Pat. No. 5,029,656, which is a continuation-in-part of pending application Ser. No. 381,040 filed July 17, 1989, now the U.S. Pat. No. 4,989,680.

BACKGROUND OF THE INVENTION

This invention relates to rotary drill bits for drilling oil wells and the like, and more particularly to an improved hydraulic action of drilling fluid against the roller cutters of the drill bit and the earth formation being drilled.

While conventional drill bits have been satisfactory for drilling relatively brittle formations, they do not provide satisfactory rates of penetration when drilling relatively plastically deformable formations. Many commonly encountered formations such as salts, shales, limestones, cemented sandstones, and chalks become plastically deformable under differential pressure conditions when the hydrostatic pressure of the column of drilling fluid bearing on the bottom and corner of the well bore exceeds the pressure in the pores of the formation surrounding the bore.

In addition to compressive strengthening of plastic formations, high drilling fluid pressure causes the well known "chip hold down" phenomenon, where rock cuttings formed by the bit teeth are held in place by the pressure on the bore hole surface resulting in regrinding of the cuttings and decreased penetration rates. Weighting particles and drilled formation particles entrained in the mud increase the severity of chip hold down by blocking the flow of drilling fluid into the formation fractures and pore spaces, thereby restricting equalization of the bore hole and formation pore pressures and preventing chip release. In many impermeable formations such as shale, only a relatively small amount of fine particles is sufficient to seal off the formation fracture openings and severely limit chip removal.

Under these conditions "bit balling" often occurs where the reground cuttings and solid particles remaining on the hole bottom tend to adhere to the roller cutter, particularly in "sticky" formations such as shales, limestones, and chalks. The cuttings and fine solids are trapped between the well bore surfaces and the teeth and body of the rolling cutter, thereby being compressed by the drilling weight applied to the cutter as it is engaged to cut the formation. Compression of the solids onto the cutter surface builds a hard coating between and around the cutting teeth, often of sufficient thickness to reduce the effective protrusion of the cutting elements and limit their drilling effectiveness.

Numerous attempts have been made to overcome chip hold down and bit balling tendencies by modifying the configuration of the hydraulic nozzles to improve the cleaning efficiency and distribution of the drilling fluid energy. In U.S. Pat. No. 2,192,693, Payne describes a rolling cutter bit with an open hydraulic passage near the center of the bit body which flushes drilling fluid over an outer gage row of teeth. The hydraulic passage directs a relatively low velocity stream of drilling fluid directly toward the uppermost portion of the cutter to achieve a flushing action normal to the body of the rotating cutter.

Bennett in U.S. Pat. No. 3,618,682 dated Nov. 9, 1971 provides an extended enclosed passageway for the drilling fluid to a point adjacent the teeth at the bottom of the hole. The flow channel for the drilling fluid after striking the side wall is directed downwardly while enclosed by the leg and the adjacent side wall until exiting closely adjacent the corner of the bore hole. Bennett is used with a low pressure fluid and thereby can not take advantage of the high velocity cleaning power available from jet nozzles. The change in direction of a high velocity drilling fluid by the flow channel in the leg of the bit would result in substantial erosion with a high velocity drilling fluid.

Feenstra in British Patent No. 1,104,310 dated Feb. 21, 1965 utilizes an angled jet nozzle at the end of an extended tube to direct a fluid stream underneath the roller cutter at the outer row of teeth in cutting engagement on the bottom of the hole. The abrasive action resulting from a substantial change in direction of the drilling fluid causes erosion as well as reducing the flow velocity. In addition, requirements for the flow area and wall thickness of the flow channel give rise to compromises between design space and structural integrity. For these reasons, curved high velocity flow channels directing fluid under the cutting teeth have had limited success in rolling cutter bit applications.

A method to improve hole cleaning without extended flow channels is shown by Lopatin, et al in Russian Patent No. 258,972 published Dec. 12, 1969 where a rolling cutter drill bit has nozzle passages directed downwardly and radially outwardly against the side wall of the bore hole to strike above the bottom corner, providing an inwardly sweeping fluid stream having a high velocity across the corner and bottom of the well bore tangential to the formation surface. This design serves to clean solids away from the fracture openings at the surface of the formation, reduce the hold-down pressure on the fractured cuttings, and facilitate removal of dislodged cuttings by the high velocity fluid stream.

Childers, et al, in U.S. Pat. Nos. 4,516,642 and 4,546,837 employ a high velocity flow stream or fluid jet to first clean the cutting elements on a rolling cutter bit and then clean the formation at the bottom of the hole. The fluid jet trajectory passes the cutter tangential to its outer periphery with a portion of the jet volume impinging on the cutting elements and the remainder of the jet volume striking downwardly on the hole bottom underneath the cutter body slightly forward of cutting elements engaging the formation. The cleaning of both the cutter and the well bore bottom in separate and sequential actions provides improved penetration rates by attacking both bit balling and chip hold down. Deane, et al in U.S. Pat. No. 4,741,406, add a modification to this concept in which the fluid jet cleans both the rolling cutter teeth and the formation with an improved flow pattern. High velocity fluid flows radially outwardly and downwardly to impinge upon the hole bottom, then turns upwardly while moving toward the outer periphery of the hole, and next returns upwardly alongside the original nozzle exit in a spaced outer return channel for enhanced transport of cuttings away from the hole bottom.

SUMMARY OF THE INVENTION

The primary object of this invention is to maximize the penetration rate of rolling cutter drill bits by providing a hydraulic nozzle configuration for delivering a high velocity flow of drilling fluid on the cutting elements and the formation at the contact engagement area of the cutting elements with the formation with minimal erosion of the nozzle flow passageways.

The invention utilizes the geometry or geometrical configuration of the roller cutters and the cutting paths of the teeth at various positions on the cutter to insure intimate contact of the high velocity flow with cutting engagement areas. Special consideration is given to the outermost or gage row of cutting elements or teeth for cutting the corner surface where the formation is difficult to cut and balling of the teeth is prevalent. The gage row of cutting elements or teeth cut the side wall and diameter of the well bore, the outer periphery of the well bore bottom surface, and the corner surface between the side wall and bottom surfaces. The remaining rows of cutting elements cut the remaining bottom surface. The nozzle discharge orifice is positioned between and above the roller cutters without any nozzle extension being required. Such a nozzle orifice position accelerates and directs a high velocity drilling fluid downwardly and outwardly with the center of the volume of the stream being directed toward an impact point on the side wall at or above the corner surface so that a majority of the fluid sweeps first across the corner surface and then across the bottom surface. The center of the volume of the fluid stream is slanted toward one of the adjacent roller cutters so that a substantial portion of the high velocity stream swirls around the corner surface to scour the formation at the cutting engagement contact location of the gage row with the formation. While much of the prior art has provided some increase in penetration rates, it has been found that certain aspects of the nozzle position and direction of the fluid flow path therefrom are more important than expected.

The outermost or gage row of cutting elements for each roller cutter is the row that most affects the rate of penetration of the rotary drill bit. The formation is stronger at the annular corner of the bore hole formed at the juncture of the horizontal bottom surface and the vertically extending cylindrical side surface of the bore hole formation. Thus, the outermost or gage row of cutting elements is the critical row in determining the rate of penetration. It is important that maximum cleaning action by the pressurized drilling fluid be provided particularly for the cutting elements in the outermost or gage row at the cutting engagement of such cutting elements with the formation, and preferably at the cutting engagement of other rows of cutting elements.

Application Ser. No. 381,040, now U.S. Pat. No. 4,989,680, relates to a roller cutter drill bit in which a high velocity stream of drilling fluid is directed against the cutting elements in the gage row to provide an increased hydraulic action first against the cutting elements in the gage row and then sequentially against the bore hole bottom generally adjacent the corner of the bore hole.

The present invention likewise is directed to an improved hydraulic action for the cutting elements in the gage row. However, the drilling fluid is discharged in a direction toward an adjacent roller cutter with the center of the volume of drilling fluid first impacting the side wall of the bore hole at an impact point on the side wall at or above the corner surface so that a substantial portion of the fluid scours the corner surface at the cutting engagement contact location of the gage row with the formation, and sweeps across the bottom surface at the cutting engagement contact location of the cutters. The stream of drilling fluid is directed against the side wall and slanted toward an adjacent roller cutter in such a manner that the velocity of the drilling fluid sweeping across the corner surface and under the cutting elements is not substantially reduced after impacting the side wall of the bore hole so that adequate velocity is retained for the subsequent sweeping action. The high velocity stream after impacting the side wall sweeps with a thin high velocity swirling action along the side wall and around the corner surface, and then beneath the cutter across the bottom hole surface to scour and clean the corner and bottom surfaces at the cutting engagement contact locations of the cutting elements.

The stream of drilling fluid from the nozzle is slanted toward an adjacent roller cutter at a sufficient angle to provide a swirling action first around the corner surface at the cutting engagement area of the gage row, and then a sweeping action across the hole bottom at the cutting engagement areas of other cutting elements of the associated cutter for the effective cleaning of the formation at the specific location where there is engagement of the cutting elements. With discharge nozzles positioned generally centrally between the cutters, the high velocity stream of drilling fluid is slanted toward an adjacent cutter and directed against the side wall at a slant impact angle away from a radial direction at least around fifteen (15) degrees and preferably between thirty (30) and fifty (50) degrees for normal three cutter bits. It is difficult to achieve slant impact angles of greater than fifty (50) degrees on normal three cutter bits due to geometry restrictions. Other bit designs such as two cutter bits might achieve improved results with larger slant impact angles than fifty (50) degrees depending on the nozzle exit position. Such a slant impact angle for the high velocity stream has been found to be desirable for directing sufficient high velocity fluid flow around the corner surface at the cutting engagement contact locations, and then underneath the roller cutter and across the hole bottom.

The outwardly directed high velocity stream impacts the side wall above the center of the corner surface and causes a substantial portion of the stream to swirl circumferentially around the corner surface toward the associated cutter for scouring the corner surface where it is being cut by the cutting elements in the gage row. As the direction of the high velocity fluid is slanted further away from a radial direction, the more the swirling action of the stream sweeping along the corner surface is brought into contact with the formation at the cutting engagement locations of the gage row and across the hole bottom at the cutting engagement locations. An optimum penetration rate can be achieved by selecting a specific nozzle direction for a given nozzle exit position and roller cutter geometry to facilitate access of the high velocity flow to a maximum number of cutting engagement locations. It is also important to optimize contact of the high velocity stream with the associated cutter prior to impacting the side wall so that effective tooth cleaning action is obtained without excessive hydraulic energy loss in the high velocity stream before it strikes the side wall and sweeps across the cutting engagement locations of the gage row.

It is an object of this invention to demonstrate that removing cuttings and fine solid particles away from the cutting engagement locations for a rotary drill bit provides substantial improvements and that scouring the formation at the cutting engagement locations of the teeth in the gage row is particularly important, particularly at the corner surface which is the most difficult area of the bore hole to drill.

It is another object of the present invention to provide a rotary drill bit in which the center of a drilling fluid stream is directed from a nozzle orifice toward an impact point on the bore hole side wall at or above the corner surface between the side wall and the bottom surface for sweeping first across the corner surface and then across the bottom surface.

An additional object of the present invention is to provide a nozzle for the stream of drilling fluid positioned on the drill bit between a pair of roller cutters and directing the drilling fluid outwardly against the side wall of the bore hole and slanted toward an adjacent roller cutter to provide a swirling action to scour the formation specifically at the cutting engagement locations on the corner and bottom surfaces of the hole.

A further object is to provide an improved hydraulic cleaning action during cutting engagement employing a conventional hydraulic jet nozzle to direct a high velocity flow toward specific tooth engagement areas and without the requirement of a special passage for nozzle extension or high velocity flow redirection.

Other objects, features, and advantages of this invention will become more apparent after referring to the following specification and drawings.

DESCRIPTION OF THE INVENTION

Figure 1:
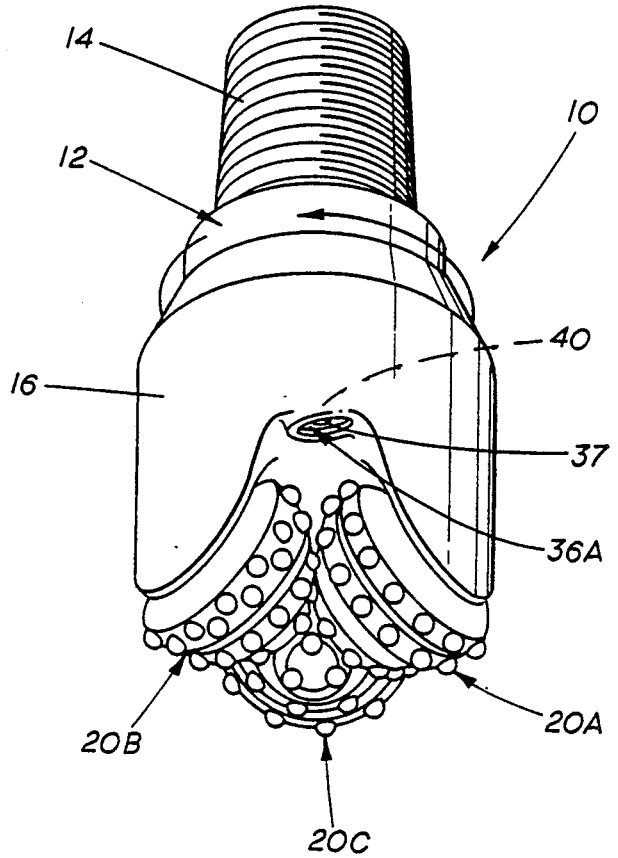
FIG. 1 is a perspective of the rotary drill bit of this invention including three cones or roller cutters of a generally conical shape thereon and discharge nozzles along the upper periphery of the bit body.
Figure 2:
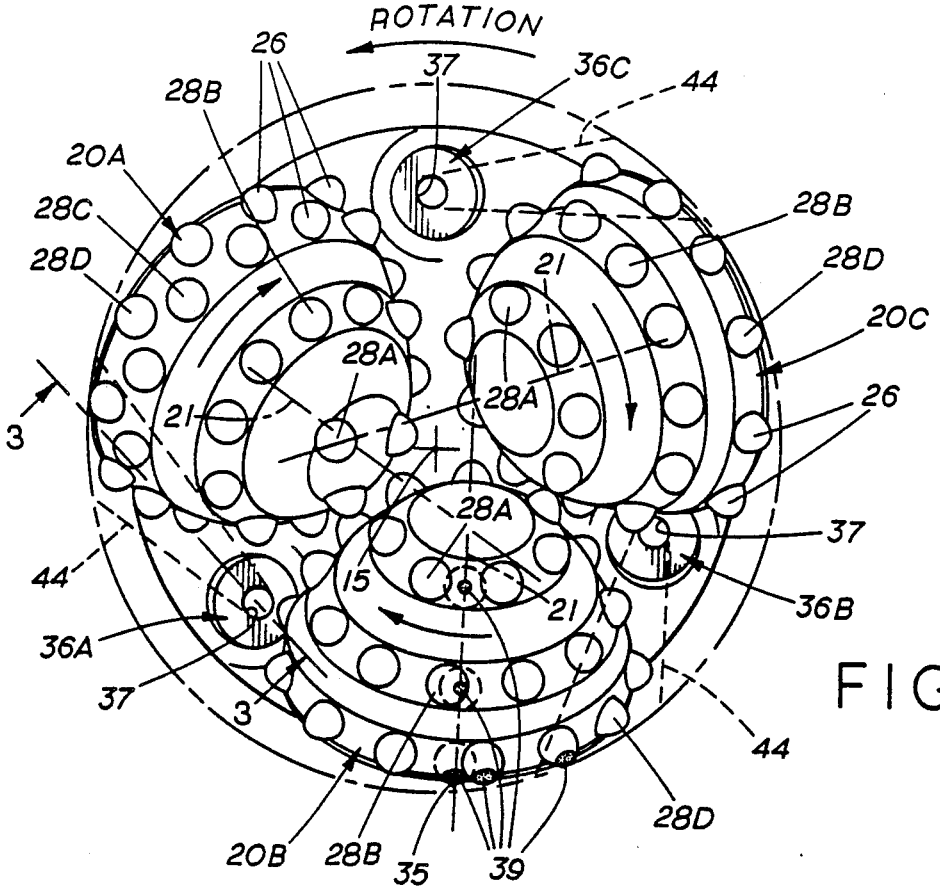
FIG. 2 is an axial plan view of the rotary drill bit of FIG. 1 showing the three roller cutters with annular rows of cutting elements thereon and a nozzle between each pair of adjacent roller cutters directing drilling fluid toward the leading side of one of the roller cutters with the fluid travelling in a direction opposite the rotation of the bit and also showing the general patterns of cutting engagement points of the cutting elements of the cutter.

Referring now to the drawings for a better understanding of this invention, and more particularly to FIGS. 1-2, a rotary drill bit 10 is shown in FIG. 1 comprising a central main body or shank 12 with an upwardly extending threaded pin 14 and mounted for rotation about a vertical axis 15. Threaded pin 14 comprises a tapered pin connection adapted for threadedly engaging the female end of a drill string (not shown) which is connected to a source of drilling fluid at a surface location.

Figure 3:
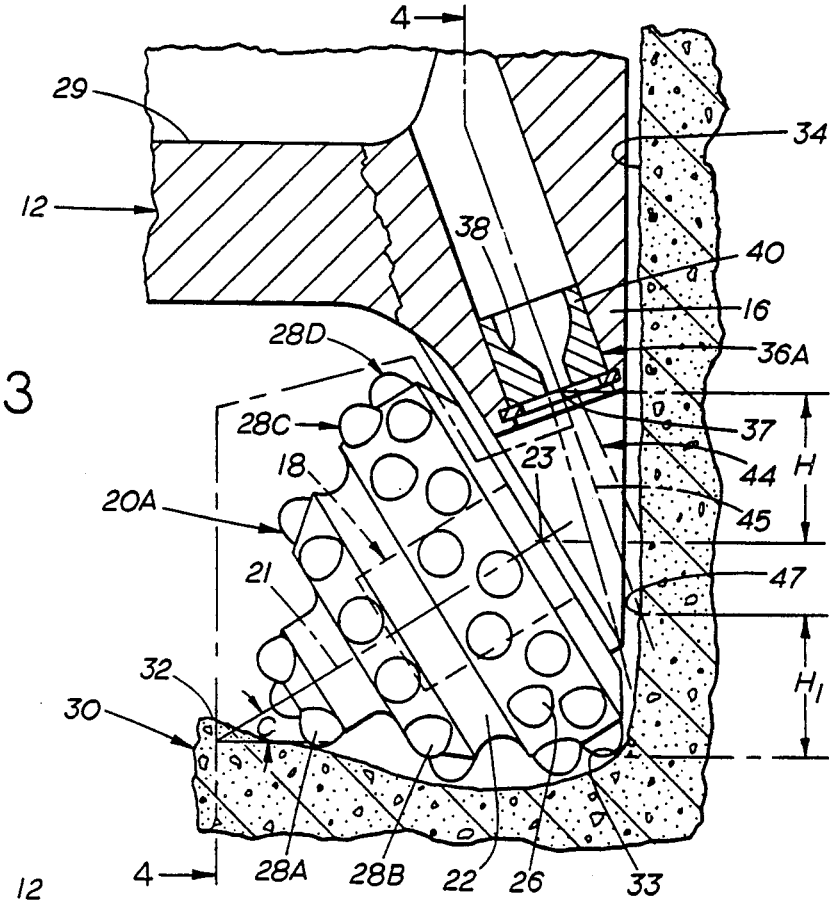
FIG. 3 is a generally schematic view of the stream of drilling fluid taken generally along line 3—3 of FIG. 2 and showing the drilling fluid directed outwardly against the side wall of the bore hole at a position above the corner surface of the cutting elements in the gage row for sweeping first along the corner surface and then beneath the cutting elements in the gage row at the cutting engagement area of the cutting elements with the formation.

Main body or shank 12 is formed from three integral connected lugs defining three downwardly extending legs 16. Each leg 16 has an inwardly and downwardly extending cylindrical bearing journal or shaft 18 at its lower end as shown in FIG. 3. Roller cutters 20A, 20B, and 20C are mounted on bearing shafts or journals 18 for rotation about longitudinal axes 21 and each roller cutter is formed of a generally conical shape as shown in FIG. 3. Bearing shafts 18 are cantilevered from depending legs 16 at a depression angle C shown in FIG. 3 for longitudinal axis 21 relative to a horizontal plane. Rotational axis 21 of cutter 20A as shown in FIG. 3 intersects leg 16 at 23. Each roller cutter 20A, 20B, and 20C comprises a generally conical body 22 having a recess therein receiving an associated bearing journal 18. A plurality of generally elongate cutting elements or teeth 26 have cylindrical bodies mounted in sockets within body 22 and outer tips extending from the outer ends of cutting elements 26. Cutting elements 26 may be made of a suitable powder metallurgy composite material having good abrasion and erosion resistant properties, such as sintered tungsten carbide in a suitable matrix. A hardness from about 85 Rockwell A to about 90 Rockwell A has been found to be satisfactory.

Cutting elements 26 are arranged on body 22 in concentric annular rows 28A, 28B, 28C, and 28D. Row 28D is the outermost row and comprises the gage row of cutting elements 26 that determines the final diameter or gage of the formation bore hole which is generally indicated at 34. Row 28C is adjacent to row 28D and comprises an interlocking row on cutter 20A. Cutting elements 26 on row 28C are staggered circumferentially with respect to cutting elements 26 on row 28D and the cutting path of elements 26 on interlocking row 28C projects within the circular cutting path of row 28D. Thus, the cutting paths of the cutting elements 26 on rows 28C and 28D of roller cutter 20A overlap. It is noted that cutters 20B and 20C do not have interlocking rows as adjacent rows 28B are spaced substantially inward of row 28D and cutting elements 26 on rows 28B do not project within the cutting path of row 28D for cutters 20B and 20C. In some instances, it may be desirable to provide two cutters or possibly all of the cutters with interlocking rows of cutting elements.

Bore hole 30 includes a generally horizontal bottom surface portion 32 and an adjacent cylindrical side wall 34 extending vertically generally at right angles to horizontal bottom 32. The corner surface between horizontal bottom surface 32 and cylindrical side wall surface 34 is shown at 33 and has a 45° tangent through its center in FIG. 6. The cutting elements 26 on gage row 28D engage the formation in cutting relation generally at the corner surface 33 formed between the generally horizontal bottom surface 32 and the generally vertical side wall surface 34, as well as adjacent marginal portions of side wall 34 and bottom surface 32 as shown in FIG. 6.

The gage row 28D of cutting elements 26 are positioned to contact and cut side wall 34 of bore hole 30, surface 33, and a marginal portion of the outer periphery of bottom surface 32 while the remaining rows 28A, 28B, and 28C are positioned to contact and cut the remainder of the bottom surface 32. The rotational axes 21 of bearing shaft 18 may be offset from the rotational axis 15 of bit 10 as shown in FIG. 2 an amount of 1/16 inch or less per inch of bit diameter as may be desired for the particular formation encountered. The bearing shaft depression angle C as shown in FIG. 3 is normally between around 28 degrees and 40 degrees. Due to the geometrical configuration of the depression angle C and offset of rotational axes 21, teeth 26 of gage row 28D engage the periphery of the well bore in a relatively complicated cutting path.

Figure 5:
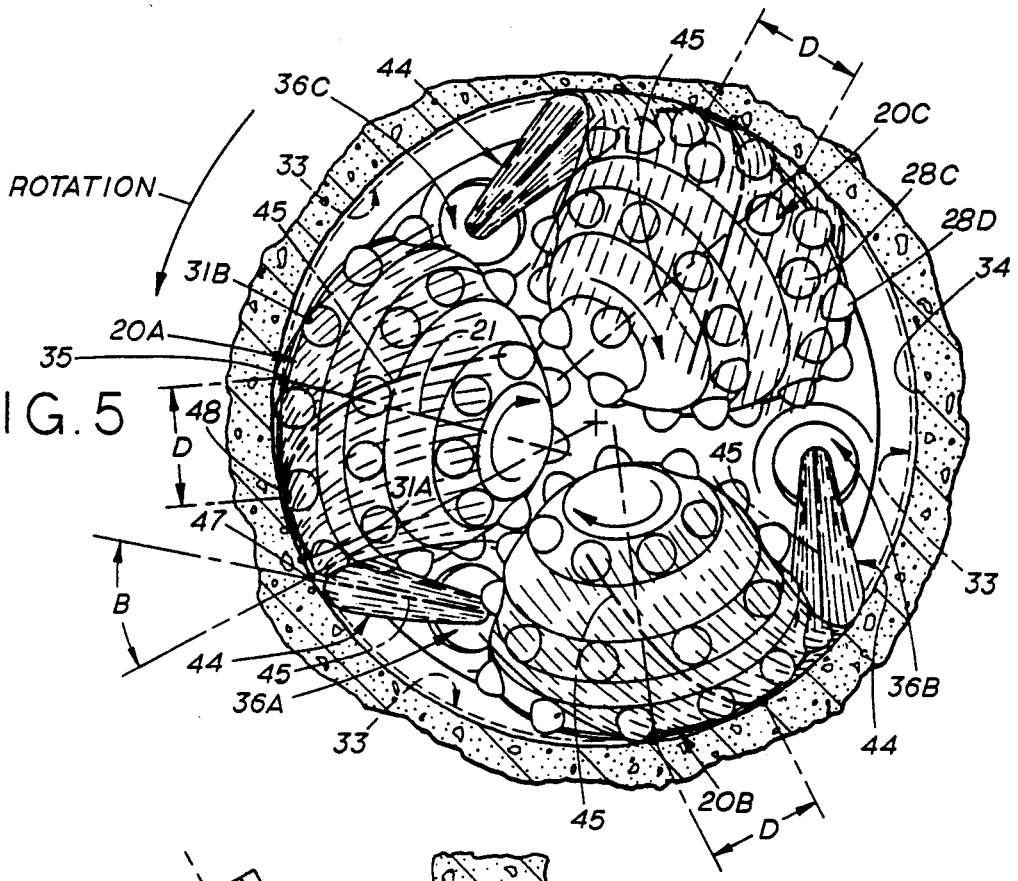
FIG. 5 is a bottom plan, partly schematic, of the streams of drilling fluid slanted away from a radial direction toward associated cutters and first impacting the side wall of the bore hole area, then sweeping along the corner surface of the side wall at the cutting engagement of the cutting elements in the gage row and then sweeping inwardly across the hole bottom surface beneath the roller cutters.
Figure 6:
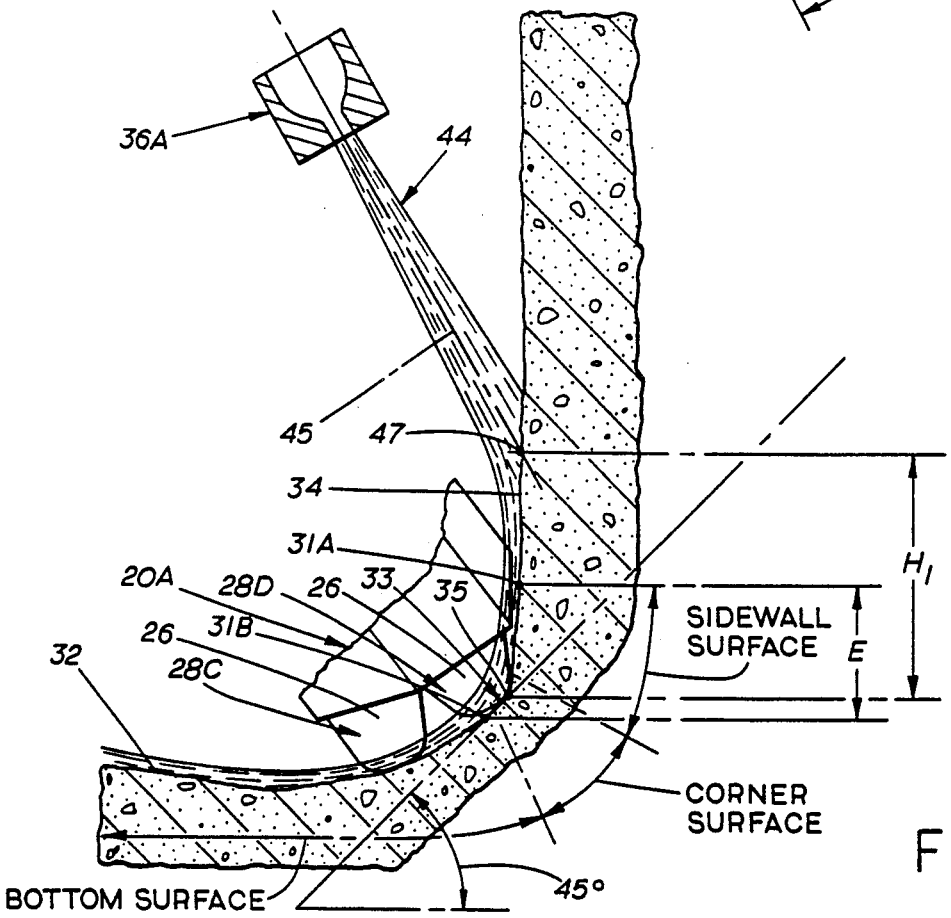
FIG. 6 is a schematic side view illustrating the stream of drilling fluid discharged from the nozzle orifice in an outward direction for impacting the side wall at a location above the cutting engagement area of the cutting elements in the gage row with the side wall and then sweeping across the hole corner surface and bottom surface in a thin high velocity tangential stream closely adjacent the bottom surface.

Referring particularly to FIG. 6, the projection of the lowermost cutting elements or teeth 26 in the outermost or gage row 28D and in the interfitting row 28C are shown schematically for engaging bore hole 30 in cutting relation. As shown in FIG. 6, gage row 28D engages the formation in cutting relation at the corner surface 33 between the cylindrical side wall surface 34 and bottom surface 32. Several teeth 26 in gage row 28D may be in simultaneous cutting engagement with the periphery of bore hole 30 with a cutting element 26 intially engaging side wall portion 34 on the leading side of cutter 20A at an upper point 31A and then disengaging bottom wall surface 32 as shown at lower point 31B in FIG. 6. Initial upper contact point 31A is generally around ½ to 1½ inches above the lowermost contact point 31B of cutting cutting elements 26 and spaced horizontally against the rotation of the bit from point 31B around 2 inches, for example. As bit 10 and roller cutter 20A rotate, cutting elements 26 in gage row 28D proceed downwardly along side wall surface 34 from upper point 31A. As cutting elements or teeth 26 move downwardly along side wall surface 34, the formation is cut with a dragging, shearing action at the outer surfaces of teeth 26 in gage row 28D. As teeth 26 approach their lowermost position, the amount of drag is reduced so that teeth 26 cut first the corner surface 33 and then cut a marginal portion of the bottom surface 32 of hole 30 with a partial scraping action and a partial crushing action. The cutting engagement of corner surface 33 is generally located at the lowermost position of the cutting elements in gage row 28D and is shown at point 35 in FIGS. 5 and 6 at the center of corner surface 33. Soon after proceeding past the lowermost position shown by tooth 26, the teeth disengage corner surface 33 and disengage hole bottom surface 32 at lower point 31B. Due to this intricate path, there are typically two (2) to four (4) teeth in gage row 28D engaged simultaneously at different cutting areas along an arcuate cutting zone adjacent the lowermost tooth 26 including corner surface 33 and adjacent marginal portions of bottom surface 32 and side wall surface 34 between upper and lower points 31A and 31B. The distance E between the cutting points from the initial side wall contact at upper point 31A to disengagement on the trailing side of the cutter adjacent lower point 31B as shown in FIG. 6 varies with such factors as the bearing shaft depression angle C, the offset of rotational axis 21, the conical cutter geometry, the type of formation, and other drilling conditions.

In contrast to cutting elements 26 in gage row 28D, the cutting elements in inner rows 28A, 28B, and 28C engage only the hole bottom 32 with a relatively simple and comparatively short cutting path at cutting areas directly beneath the associated cutter. The cutting action occurs primarily as a vertical motion into and out of the formation, with a slight amount of drag across the hole bottom. The amount of drag depends upon various factors such as for example, the bearing shaft depression angle C, the offset of rotational axis 21, the configuration of the cutter, the type of formation, and drilling conditions.

Therefore, the geometry of the roller cutter bit results in a number of cutting engagement points for the cutting elements in gage row 28D and inner rows 28A and 28B as shown in FIG. 2 at 39. The cutting elements in their lowermost cutting position are shown as broken lines in FIG. 2. It is in this position that the corner surface and inner areas of the bore hole are cut. This occurs directly below the center of rotation of the cutter. These cutting engagement points are located in a generally L shaped pattern with the gage row cutting the side wall at the outer end of the pattern and the inner rows cutting the hole bottom at the inner end of the pattern. The corner surface 33 is cut at the corner of the L shaped pattern as shown particularly in FIGS. 5 and 6. This pattern of cutting locations provides an opportunity for substantial increases in rate of penetration provided that a fluid nozzle design is provided to maximize fluid cleaning action between the formation and cutting elements at their engagement locations.

To provide high velocity drilling fluid for the improved cleaning action, particularly for the gage row 28D and adjacent interlocking row 28C of cutting elements 26, a directed nozzle fluid system is provided. The fluid system includes a plurality of nozzles indicated at 36A, 36B, and 36C with a nozzle positioned on bit body 12 between each pair of adjacent roller cutters. Each nozzle 36 has a drilling fluid passage 38 thereto from the drill string which provides high velocity drilling fluid for discharge from a discharge orifice or port 37.

For the purposes of illustrating the positioning and direction of the nozzles and associated orifices for obtaining the desired flattening of the discharged streams of drilling fluid against the side wall for sweeping along the side wall and corner surfaces of the bore hole and for cleaning the teeth prior to impacting against the side wall, reference is made particularly to FIGS. 3–6 in which nozzle 36A and roller cutter 20A are illustrated. It is to be understood that nozzles 36B and 36C function in a similar manner for respective roller cutters 20B and 20C.

Nozzle 36A has a nozzle body 40 defining discharge orifice 37 for directing fluid stream therefrom as shown at 44. Fluid stream 44 is shown of a symmetrical cross section and having a fan angle of around 5 degrees to 20 degrees, for example, about the entire circumference of the stream with the centerline of the volume of discharged fluid shown at 45. Other fan angles or non-symmetrical cross sections for fluid stream 44 may be provided, if desired. Nozzle 36A preferably is positioned with discharge orifice or port 37 at a height below the uppermost surface of roller cutter 20A as shown in FIG. 3 and at least at a height above the intersection point 23 of the rotational axis 21 of roller cutter 20A with leg 16 as shown at H in FIG. 3. At the jet or orifice exit, the drilling fluid has a maximum velocity and minimal cross sectional area. As the stream or jet travels from the exit point, the stream loses velocity and increases in cross section area. A reduction in velocity reduces the cleaning effectiveness of the stream of drilling fluid. A suitable height should provide an adequate size flow zone from the distribution of the stream with a sufficient velocity and dispersion to effectively clean the cutting elements and the formation.

It is desirable for the sweeping of the drilling fluid inwardly beneath the cutting elements on the associated cutter 20A that the drilling fluid stream 44 first impact the side wall 34 of the bore hole 30 at a location above corner surface 33 such as impact point 47. It is also important that the velocity of the drilling fluid stream 44 not be materially reduced after impacting side wall 34 so that a high velocity is maintained for the subsequent sweeping action between the side wall and cutting elements at the cutting engagement area of the cutting elements with the side wall and bore hole corner, and then for the sweeping action along the bottom surface at the cutting engagement areas of the cutters.

In addition, it is desirable for the centerline of flow stream 44 to impact the side wall at 47 above the center of corner surface 33 which is above the maximum downward projection of the lowermost cutting element 26 in gage row 28D as shown in FIG. 6 by vertical distance H1. The impact point 47 of the fluid stream 44 against the side wall 34 may vary and yet provide satisfactory results. For example, impact point 47 may be above the center of corner surface 33 only around ¼ inch and provide satisfactory results so long as the majority of the fluid stream does not directly contact a cutter and the stream is slanted toward an adjacent cutter such that a substantial portion of the high velocity fluid stream swirls around corner surface 33 at the cutting engagement area of teeth 26 in gage row 28D with the formation. However, in order to maintain the high velocity stream in a direction tangential to the formation surface with a maximum volume for sweeping across bottom surface 32 underneath cutter 20A, it is believed that height H1 should not be above around 5 inches and preferably should not be greater than around 3 inches for an 8¾ diameter bit. It is further noted that side wall 34 tends to flatten stream 44 into a stream for sweeping first along the side wall behind the cutting elements of the gage row and then across bottom surface 32. As shown particularly in FIG. 5, for example, stream 44 is of a generally frustoconical shape from orifice 37 to side wall 34.

The centerline 45 of the high velocity stream 44 passes across the center of corner surface 33 at point 48 as shown in FIG. 5. The corner cutting location shown at 35 in FIG. 5 is generally located on the center of corner surface 33 directly beneath the rotational axis 21 of cutter 20A which is the maximum projection of gage row 28D on the hole bottom. After impacting side wall 34 at 47, stream 44 is converted into a flat wide stream for sweeping first along the side wall surface below initial contact point 31A and along corner surface 33, then across the hole bottom surface 32 at a high velocity generally tangential to the surface of the formation.

Figure 7:
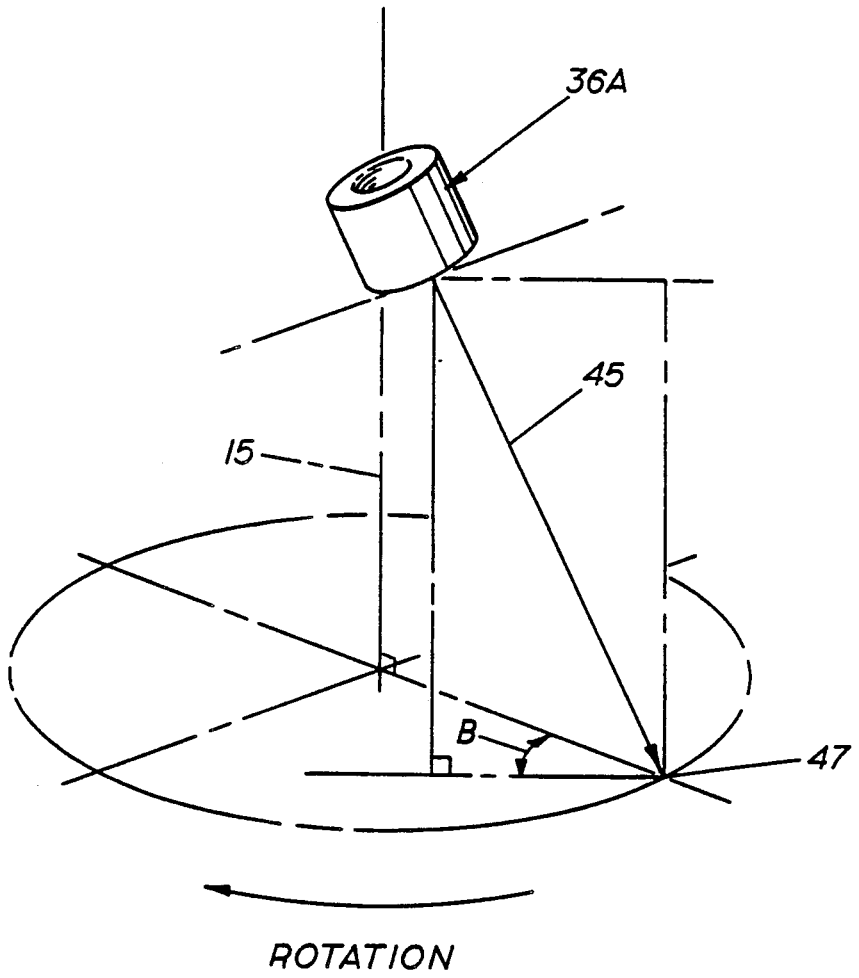
FIG. 7 is a schematic illustrating the position of the discharge nozzle and the slanting of the high velocity stream away from a radial direction for impacting the side wall at a desired slant impact angle.

In order for the drilling fluid stream 44 to gain access to swirl circumferentially around corner surface 33 and sweep under the cutting elements of gage row 28D at cutting engagement, it is desirable to slant stream 44 away from a radial direction toward the leading side of cutter 20A against bit rotation as shown by slant impact angle B in FIGS. 5 and 7 for impacting the side wall at an inclined angle so that a substantial portion of the high velocity fluid stream sweeps across corner surface 33 at the cutting engagement area thereof by cutting elements 26 in gage row 28D. In order to obtain an adequate swirling of the high velocity fluid stream around corner surface 33 and then across the adjacent bore hole bottom 32 at the cutting engagement locations, it has been found that slant impact angle B for impacting against the side wall at or above corner surface 33 should be at least around twenty (20) degrees and of a range preferably between around thirty (30) degrees and fifty (50) degrees for best results for nozzles located centrally between a pair of adjacent cutters on a bit with three rolling cutters. It is believed that improved results may be obtained with slant impact angle B as low as around fifteen (15) degrees and higher than fifty (50) degrees, particularly if utilized with less restrictive bit constructions that allow nozzle positions removed from a central location between cutters, such as a two cutter bit.

Figure 4:
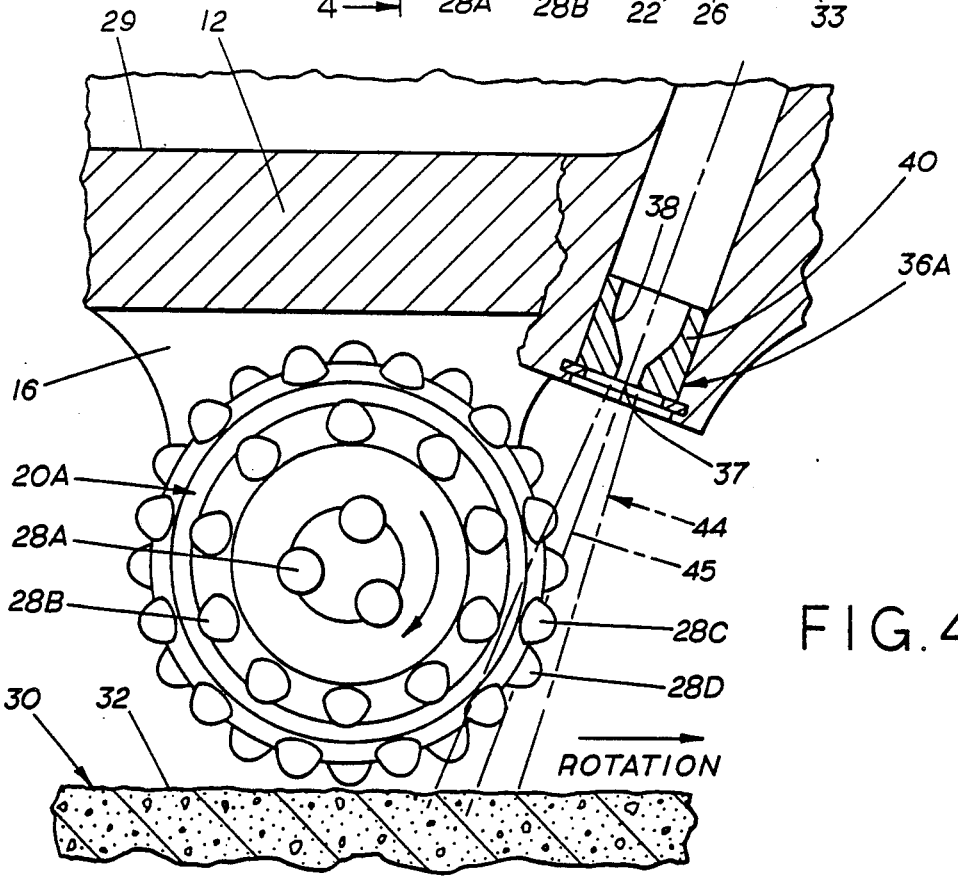
FIG. 4 is a generally schematic view taken generally along line 4—4 of FIG. 3 and showing the stream of drilling fluid slanted in a direction away from a radial direction toward the leading side of an adjacent roller cutter with a portion of the stream striking the cutting elements in the gage row prior to impacting the side wall for cleaning the cutting elements prior to cutting engagement.

As shown in FIG. 4, a side portion of stream 44 preferably contacts the projecting ends of cutting elements 26 in gage row 28D for cleaning the gage row immediately before the cutting elements 26 in row 28D engage the formation at upper point 31A in cutting relation and before impact of the stream 44 against side wall 34 at point 47 as shown in FIGS. 3 and 6. After impacting side wall 34 at 47, stream 44 is flattened and directed by side wall 34 behind cutting elements 26 in gage row 28D, then along the gage corner surface 33, and then inwardly across bottom surface 32 tangential to the formation. Thus, after impacting side wall 34 at 47, stream 44 closely follows the contour of side wall 34, corner surface 33 and bottom surface 32 in a thin high velocity stream thereby providing a relatively thin high velocity stream sweeping between the formation and cutting elements at numerous cutting engagement locations of rows 28D, 28C, 28B, and 28A for maximum cleaning effectiveness.

The nozzle orifices 37 are made of tungsten carbide or other suitable erosion resistant material and are positioned a distance H as shown in FIG. 3 above the intersection of the rotational axis of journal 18 with leg 16 shown at 23 in order to provide access for the fluid to flow beneath the gage row during cutting engagement. The nozzles accelerate the fluid and direct it outwardly toward the side wall surface and toward an adjacent cutter such that the fluid impacts the side wall of the hole at an angle away from a radial direction as shown at slant impact angle B. Nozzles 36A, 36B, 36C are each positioned between a pair of adjacent roller cutters. Nozzle 36A, for example, is positioned between roller cutters 20A and 20B and is slanted toward the leading side of roller cutter 20A with respect to direction of bit rotation. Roller cutters 20A, 20B, and 20C are spaced in a circular path at intervals of 120 degrees. Nozzle 36A is positioned generally centrally of the arc between roller cutters 20A and 20B. It is believed for effective results that nozzle 36A should be positioned not closer than a 30 degree arc to either roller cutter 20A or roller cutter 20B. Insofar as spacing of nozzle 36A is a radial direction from the longitudinal axis of rotation 15, it is believed that nozzle 36A should be spaced radially outwardly a distance at least one half the radius of the bit.

Slant impact angle B is selected not only to clean at a majority of cutting areas of the teeth on gage row 28D, but also to clean at other cutting areas of inner rows 28A, 28B, and 28C on the hole bottom as the fluid turns inwardly to sweep along the bottom hole surface 32 across the cutting engagement locations of teeth on inner rows of the cutter. It is desirable that a substantial portion of fluid stream 44 sweep across corner surface 33 in a high velocity swirling stream at the cutting engagement location of gage row 28D in order to obtain optimum results. While it is difficult for centerline 45 of fluid stream 44 to be slanted in such a manner to pass through the center of corner surface 33 at cutting engagement, it is believed that the location where centerline 45 passes across the center of corner surface 33 at point 48 as shown by distance D in FIG. 5 for an 8¾ inch diameter bit should not be spaced from the corner cutting location 35 on corner surface 33 a distance D1 over around 0.42 inch per inch of bit diameter in order to obtain best results. Distance D1 is calculated from distance D by dividing distance D by the bit diameter in inches as illustrated in following Table 1. For a drill bit having a diameter of 8¾ inches, for example, distance D is divided by 8.75 in order to obtain distance D1. As indicated previously, corner cutting location 35 is generally located on the center of corner surface 33 directly beneath the rotational axis 21 of cutter 20A. An optimum range for distance D1 with nozzles on the bit body positioned centrally of a pair of adjacent cutters would be between 0.10 and 0.30 inch per inch of bit diameter to obtain best results.

The nozzle direction and position also are adjusted to control the location where the high velocity stream passes near the cutter to clean the teeth on the gage row prior to impacting the side wall. Due to the geometrical configuration of the rolling cutter bit construction and the limited design space available, the nozzles are directed in the preferred embodiment to optimize the compromise between expending fluid energy to clean the curved side wall and corner surface behind the cutter, to clean the hole bottom along inner cutting locations beneath the cutter, and to clean the cutting teeth on the side of the cutter prior to cutting engagement.

As a specific but non-limiting example of a drill bit in accordance with the invention of FIGS. 1–6 in which a high unexpected rate of penetration was obtained, a bit designated HP51A was manufactured by Reed Tool Company, Houston, Tex. having a bit diameter of 8.750 inches with the discharge nozzles having a slant impact angle B of forty-three (43) degrees striking the side wall at impact point 47 a distance H1 of 1.72 inches. Nozzle orifice 37 was positioned at a radial distance of 1.175 inches from side wall 34, a vertical height of 4 inches from the bottom of the hole, and a horizontal distance of 3.2 inches from the centerline of the bit. The centerline of the fluid stream was spaced a distance G of 0.15 inch from the outer circumference of the gage row. The gage row of inserts included thirty-six (36) inserts or cutting elements. The rate of penetration was increased around 60–65 percent as compared with conventional IADC (International Association Of Drilling Contractors) 517 bits which have nozzles located similar to the above example but with the fluid stream directed radially outwardly to impact directly on the bottom of the hole.

Figure 8:
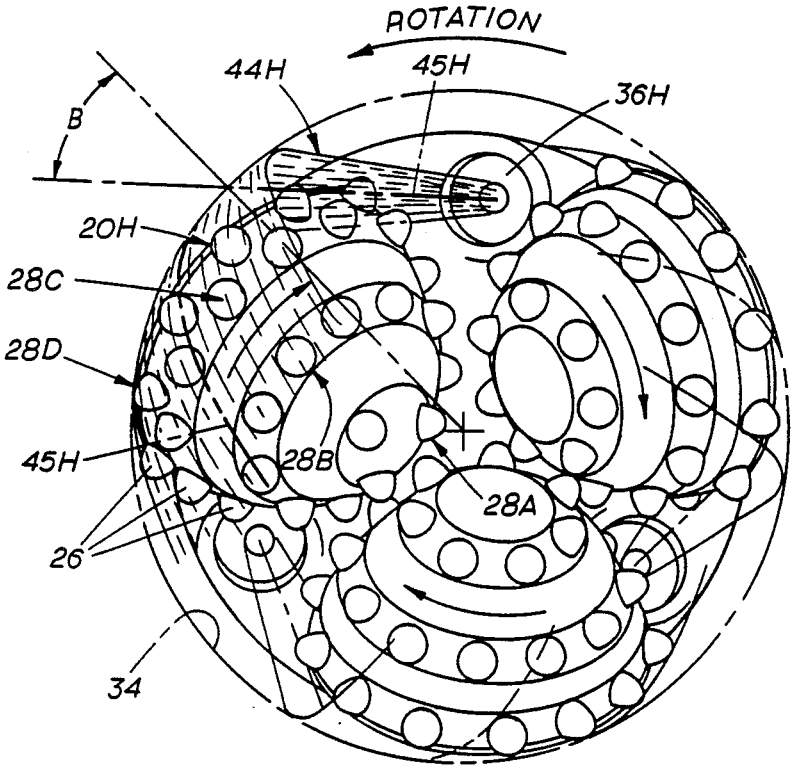
FIG. 8 is a bottom plan, partly schematic of a modified rotary bit of this invention in which the high velocity fluid stream is slanted away from a radial direction toward the trailing side of an adjacent roller cutter from a nozzle orifice.
Figure 9:
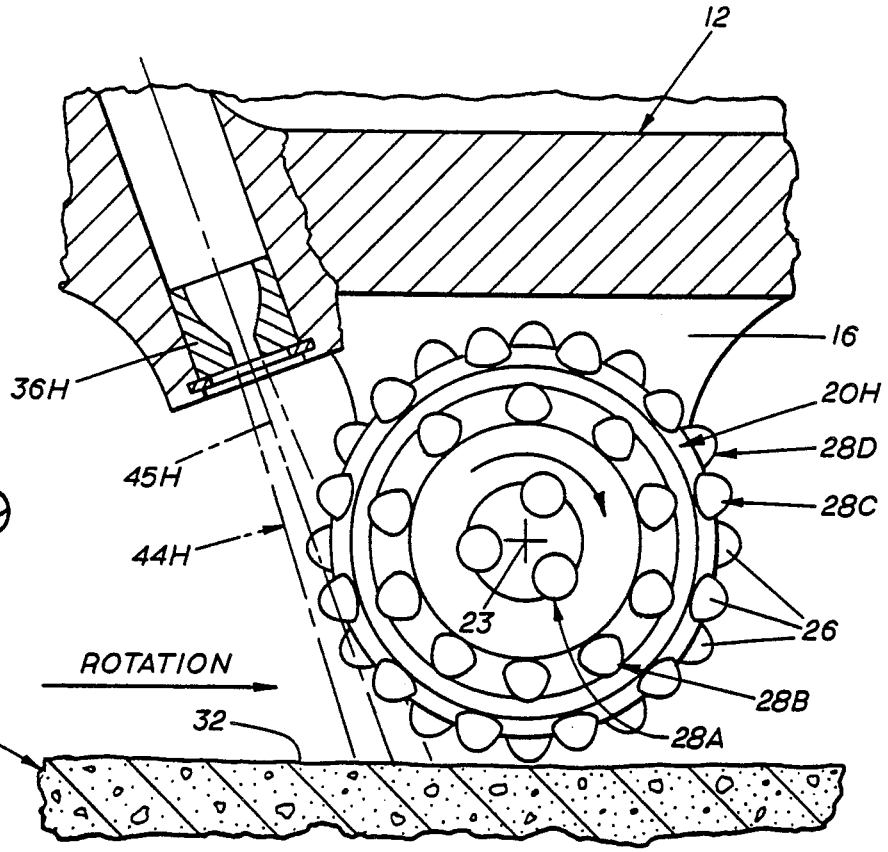
FIG. 9 is a generally schematic view of the modified embodiment shown in FIG. 8 showing the stream of drilling fluid slanted away from a radial direction toward the trailing side of an adjacent roller cutter with a portion of the stream striking the cutting elements in the gage row prior to impacting the side wall of the bore hole.

Referring to FIGS. 8 and 9, a modified nozzle configuration is shown in which the centerline 45H of the stream 44H of drilling fluid from the nozzle 36H is slanted toward the trailing side of the cutter 20H in the direction of bit rotation with stream 44H sweeping between the side wall 34 and cutting elements 26 on gage row 28D at the trailing side of cutter 20H for cleaning a plurality of cutting elements 26 immediately after disengagement from the formation. The slant impact angle shown at B in the embodiment of FIGS. 1–7 for stream 44 is similar to angle B for the stream 44H of the nozzle configuration shown in FIGS. 8 and 9. Except in regard to being slanted toward the trailing side in the direction of bit rotation instead of the leading side of roller cutter 20H against bit rotation, fluid stream 44H flows in a manner similar to stream 44 of the embodiment of FIGS. 1–7.

Referring now to FIGS. 10–14, these views illustrate the results of extensive testing of various nozzle positions on a roller cutter. To illustrate the advantages of the invention, a series of test bits were constructed with various nozzle modifications and tested under controlled simulated field conditions. Distances G shown in FIG. 8 illustrate the minimum distance between the centerline of the fluid stream and teeth 26 of the gage row 28D. It is important in order to obtain best results that the centerline of the fluid stream be close to the teeth 26 of gage row 28D. For improved results it is believed that distance G should not be greater than around one (1) inch and for best results it is believed that G should not be greater than around 0.70 inch. It was noted that improved results are obtained where more hydraulic energy is directed against the cutting elements in gage row 28D than against the cutting elements in the remaining rows.

The test equipment included a full size drilling rig similar to that used in commercial field operations and equipped with a pressurized vessel containing selected rock formations. Although the performance of the various nozzle modifications was tested under a variety of conditions, the majority of evaluations was with one specific set of test conditions to provide a basis for comparison of the nozzle modifications. These conditions were: mancos shale rock formation, 9.2 lb/gal chrome lignosulfate drilling fluid circulated at 250 GPM through three 13/32 inch diameter bit nozzles, formation pore fluid pressure of 0 psi, bore hole fluid pressure of 700 psi, 30,000 pounds weight on bit, and a rotation of 90 bit RPM. These conditions represent an average of commonly encountered drilling situations in so-called "soft to medium" formations. All tests were run on 8¾ inch diameter bits with identical IADC 517 cutting structure designs. While some nozzle exit locations for the high velocity fluid were slightly different in the test bits, the nozzles were located generally centrally between the cutters and any variance was less than ½ inch. The following table describes the nozzle designs that were evaluated.

TABLE 1

TEST RESULTS OF NOZZLE DESIGNS TESTED IN MANCOS SHALE

| Design | Nozzle Design | Cutter Teeth Cleaning Action | Formation Impact Point | ROP % Increase |
|---|---|---|---|---|
| P1 (Prior Art) | Conventional Bit | None | Bottom | 0 |
| P2 (Prior Art) | Directed Radially Outward | None | Sidewall | 13 |
| R (Prior Art) | Slanted Toward Cutter | Tangential Flow | Bottom | 20 |
| S1 | Present Invention | Tangential Flow | Sidewall, Leading Side | 49 |
| S2 | Present Invention | Tangential Flow | Sidewall, Leading Side | 38 |
| T | Present Invention | Tangential Flow | Sidewall, Leading Side | 41 |
| V | Present Invention | Tangential Flow | Sidewall, Leading Side | 48 |
| U | Present Invention | Tangential Flow | Sidewall, Leading Side | 49 |
| W | Present Invention | Tangential Flow | Sidewall, Leading Side | 64 |
| X | Present Invention | Tangential Flow | Sidewall, Leading Side | 70 |
| Z1 | Present Invention | Tangential Flow | Sidewall, Leading Side | 43 |
| Z2 | Present Invention | Tangential Flow | Sidewall, Leading Side | 37 |
| Z3 | Present Invention | Tangential Flow | Sidewall, Leading Side | 18 |
| Y | Present Invention | Tangential Flow | Sidewall, Trailing Side | 25 |
| Q | Present Invention | None | Sidewall, Trailing Side | 16 |

| Design | Slant Impact Angle B | Distance D | Distance D1 | Distance G | Height H1 |
|---|---|---|---|---|---|
| P1 (Prior Art) | N/A | N/A | N/A | 1.38 | N/A |
| P2 (Prior Art) | 0° | 4.38 | .500 | 1.26 | .60 |
| R (Prior Art) | N/A | N/A | N/A | .54 | N/A |
| S1 | 35° | 3.60 | .411 | .32 | .60 |
| S2 | 44° | 3.60 | .411 | .32 | .10 |
| T | 34° | 3.44 | .394 | .16 | .28 |
| V | 36° | 3.37 | .385 | .10 | .44 |
| U | 34° | 3.47 | .396 | .16 | 1.24 |
| W | 41° | 2.71 | .308 | 0.20 | 1.56 |
| X | 43° | 1.99 | .217 | .15 | 1.72 |
| Z1 | 37° | 2.56 | .292 | .32 | 1.72 |
| Z2 | 34° | 3.05 | .342 | .64 | 1.72 |
| Z3 | 29° | 3.54 | .400 | 1.04 | 1.72 |
| Y | −44° | 3.60 | .411 | .32 | .60 |
| Q | −24° | 4.38 | .500 | 1.36 | .60 |

D - Distance of Centerline Of Fluid Stream From Corner Surface In Inches For 8¾ Inch Diameter Bit
D1 - Distance of Centerline Of Fluid Stream From Corner Surface In Inches Per Inch Of Bit Diameter
G - Distance of Centerline Of Fluid Stream In Inches From Outer Circumference of Gage Row
H1 - Height Of Centerline Of Fluid Stream From Center Of Corner Surface In Inches
N/A - Not Applicable To Designs With Bottom Impact Points Due to the mechanical difficulties previously described, prior art designs with extended or curved high velocity fluid channels extending below the intersection of the rotational axis of the roller cutter with the supporting leg were not considered.

Figure 10:
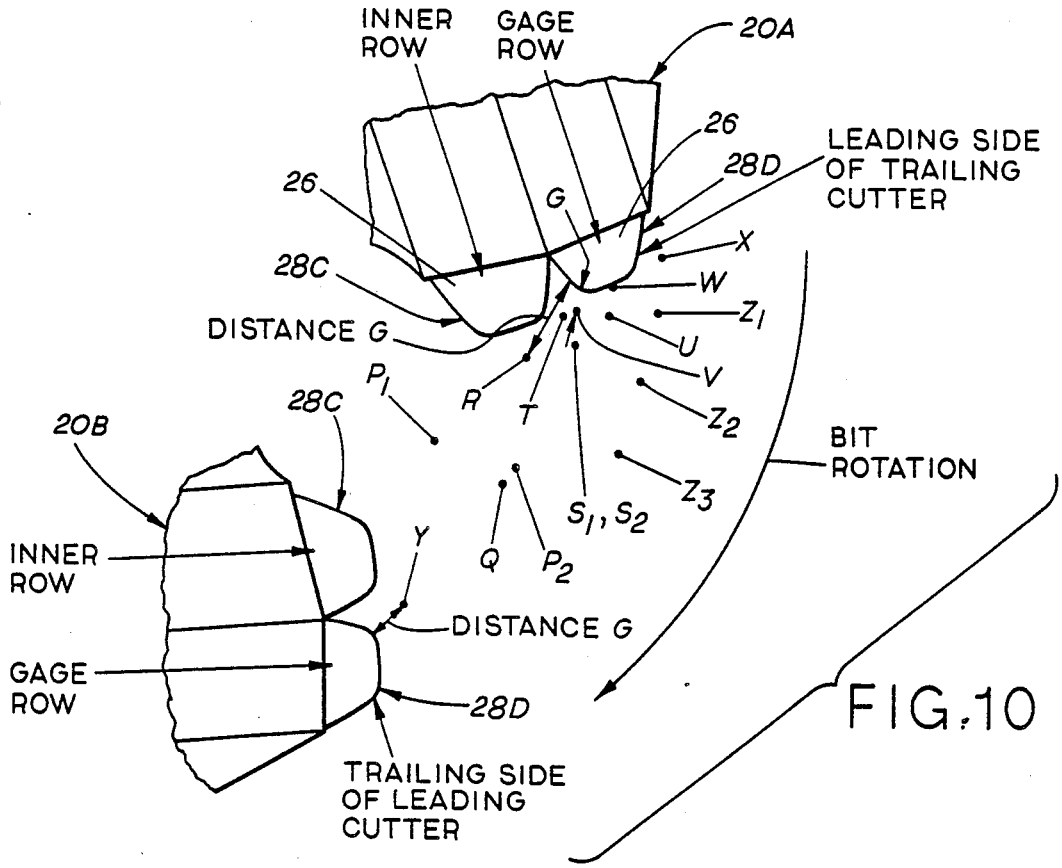
FIG. 10 is a schematic view showing the position of the closest approach of the flow centerline of various streams with respect to the cutting elements before impacting the side wall with the various streams directed toward an adjacent roller cutter and utilized in a series of comparison tests for determining the rate of penetration for the various fluid stream positions.
Figure 11:
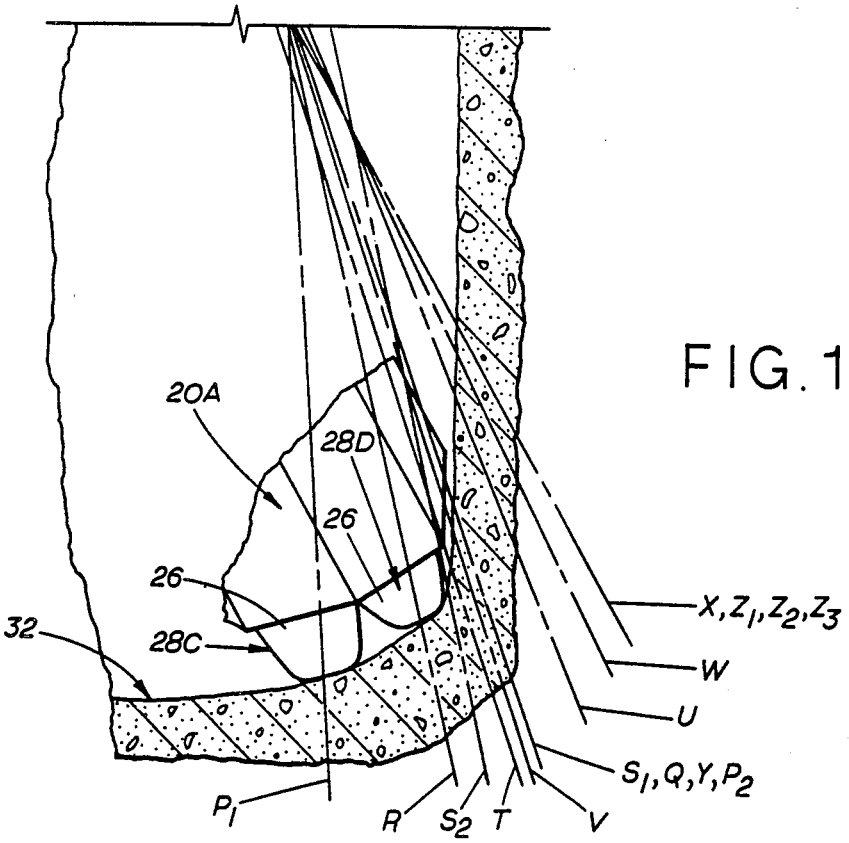
FIG. 11 is a schematic showing the height above the corner surface at which the various fluid streams shown in FIG. 10 impact the sidewall.

FIGS. 10 and 11 show where the center of the fluid flow is directed toward an adjacent cutter and impacts the side wall. After exiting the nozzle orifice, the flow is represented in FIG. 10 by a dot at the center of flow and in FIG. 11 by a simple centerline. FIG. 10 shows where the high velocity core of the flow passes in proximity to the rotary paths of the gage row and adjacent inner row of teeth on the leading or trailing side of the cutter prior to engagement of the teeth into the formation. FIG. 11 shows the height above the hole bottom at the impact points of the centerline of flow against the formation for the various nozzle locations test as indicated in table 1 above.

Figure 12:
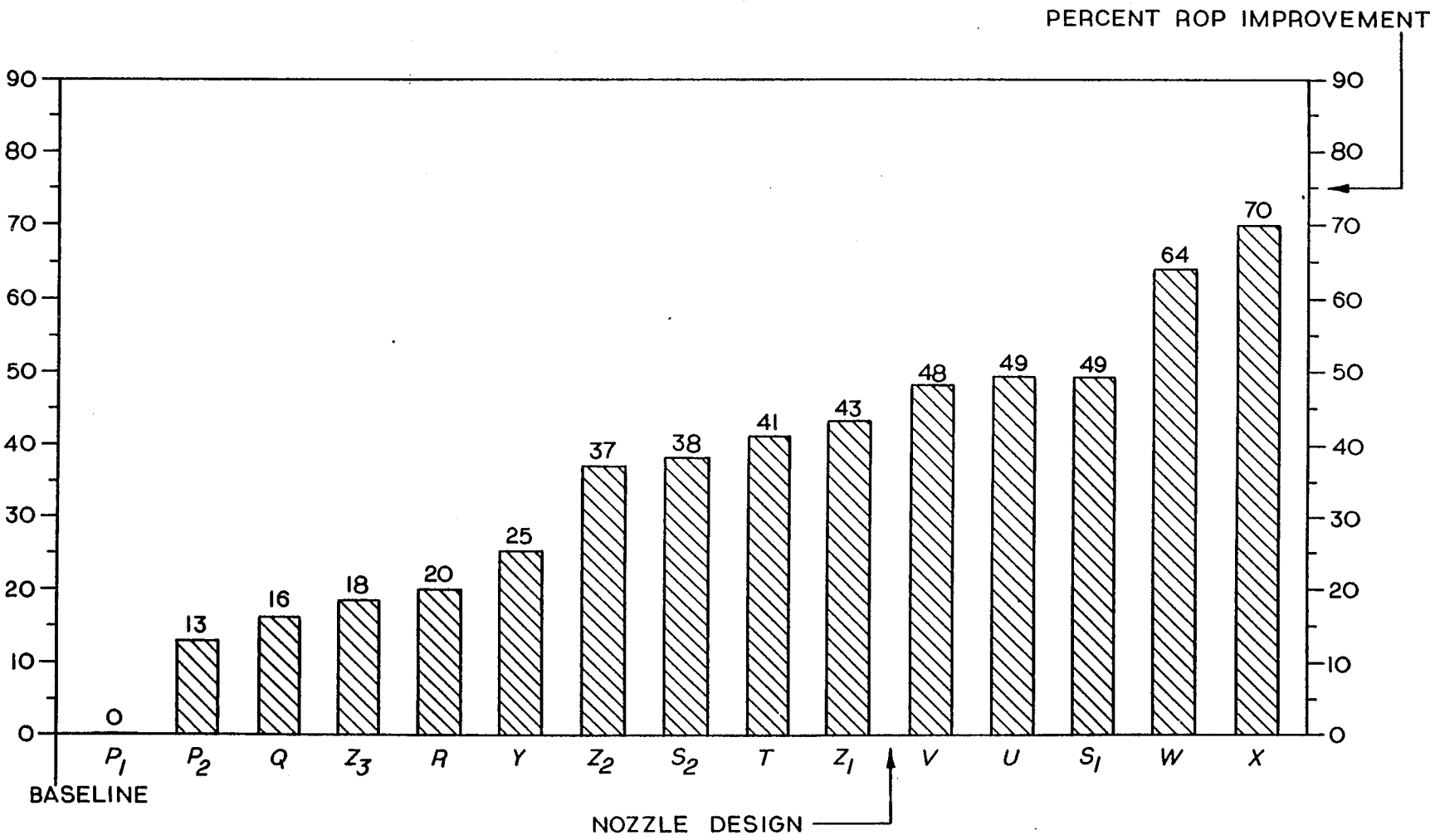
FIG. 12 is a graph comparing the rates of penetration for the nozzle locations shown in FIGS. 10 and 11.

The rate of penetration results are shown in the graph of FIG. 12. Due to substantial variations in drillability of different mancos shale rock samples, each nozzle design was run in one-half of a given rock sample against a conventional bit of Design "P1" run in the other half of the sample. This method of testing reduced overall variations in drillability comparisons to (+ or −5%). The rate of penetration of the modified nozzles was then expressed as a percent increase over that of bit design "P1" for each modified nozzle design. Design "P1" is a common nozzle design currently used in commercial well bore drilling operations and was built by taking a Reed Tool standard HP51A drill bit and converting the outwardly directed and slanted nozzles (as in design "R") to a conventional hydraulic design. The bit design "P1" utilized the same cutting structure as the other test bits and had a nozzle position with no outward inclination thereby discharging the fluid stream normally on the bore hole bottom centrally of the cutters. Thus, the centerline of the fluid stream for design "P1" did not impact the side wall as does the present invention. It is noted that the nozzle for designs Q and Y slanted a fluid stream toward the trailing side of the leading cutter as in the embodiment set forth in FIGS. 8 and 9. Multiple tests were conducted for each of the nozzle designs set forth in Table 1. Tests for all designs were run at least twice. The rate of penetration illustrated in FIG. 12 is based on an average of the results for each different nozzle design.

Two important discoveries were made from careful analysis of the test results. Unexpected increases in rate of penetration can be achieved by drilling fluid flow by (1) relatively small changes in nozzle orientation demonstrating the importance of optimizing the nozzle design, and (2) by contacting and cleaning the formation at important cutting engagement contact locations of the cutting elements in the gage row at the corner surface. Maximum improvements in rate of penetration were obtained by designs "W" and "X", which directed the fluid at a relatively steep slant impact angle B close to the cutting elements in gage row 28D to clean the formation at locations of tooth engagement on the curved side wall, corner, and bottom surfaces. Other new nozzle designs improved the rate of penetration over the prior art by directing fluid at slant impact angles away from a radial direction and close to the cutting elements in the gage row for cleaning a substantial portion of the cutting engagement locations of the teeth in the gage row.

Figure 13:
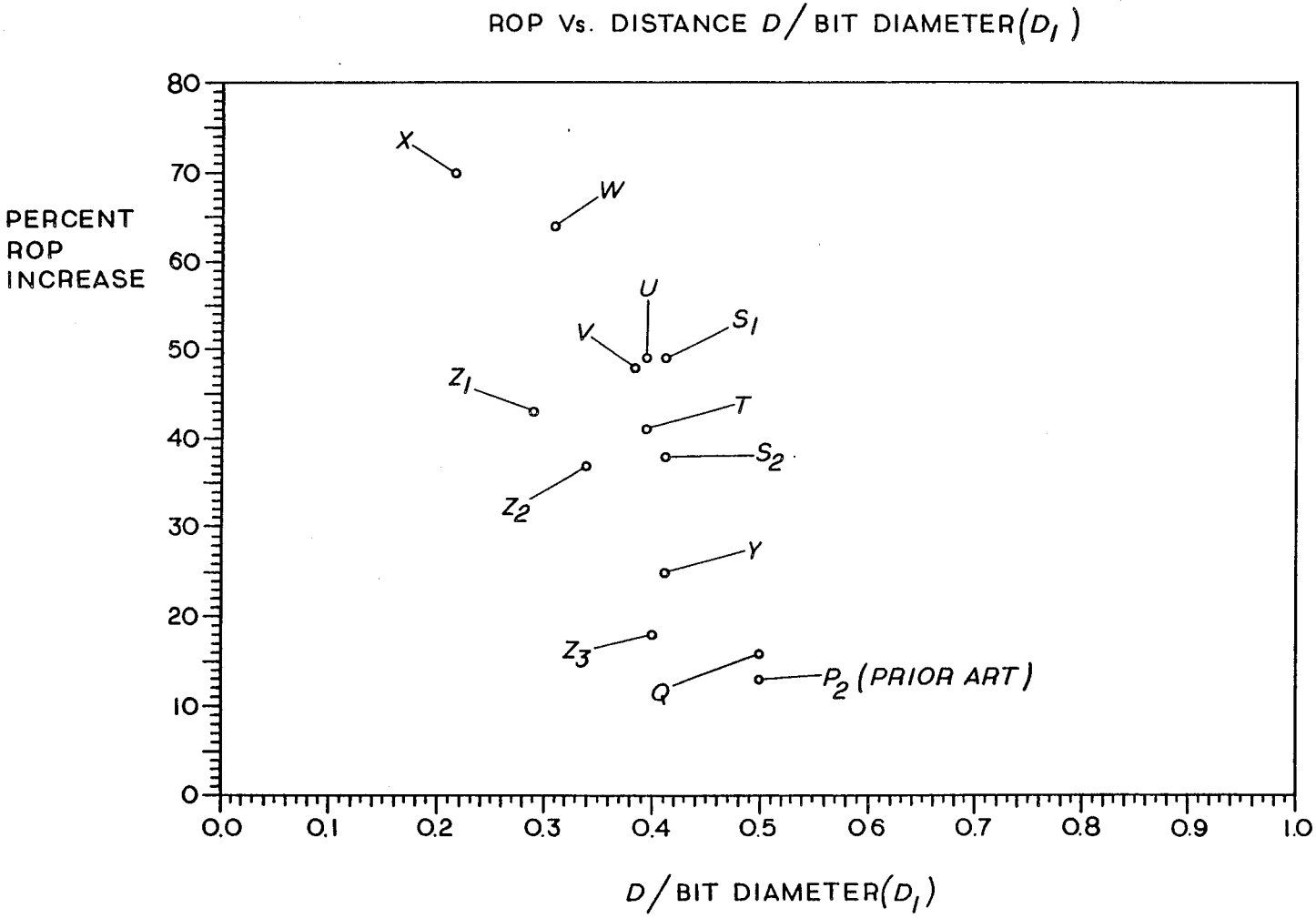
FIG. 13 is a graph comparing the rates of penetration for the various nozzle locations of this invention as a function of the distance from the point at which the center of the fluid stream crosses the center of the corner surface to the cutting engagement location at the lowermost position of the cutting elements in the gage row.
Figure 14:
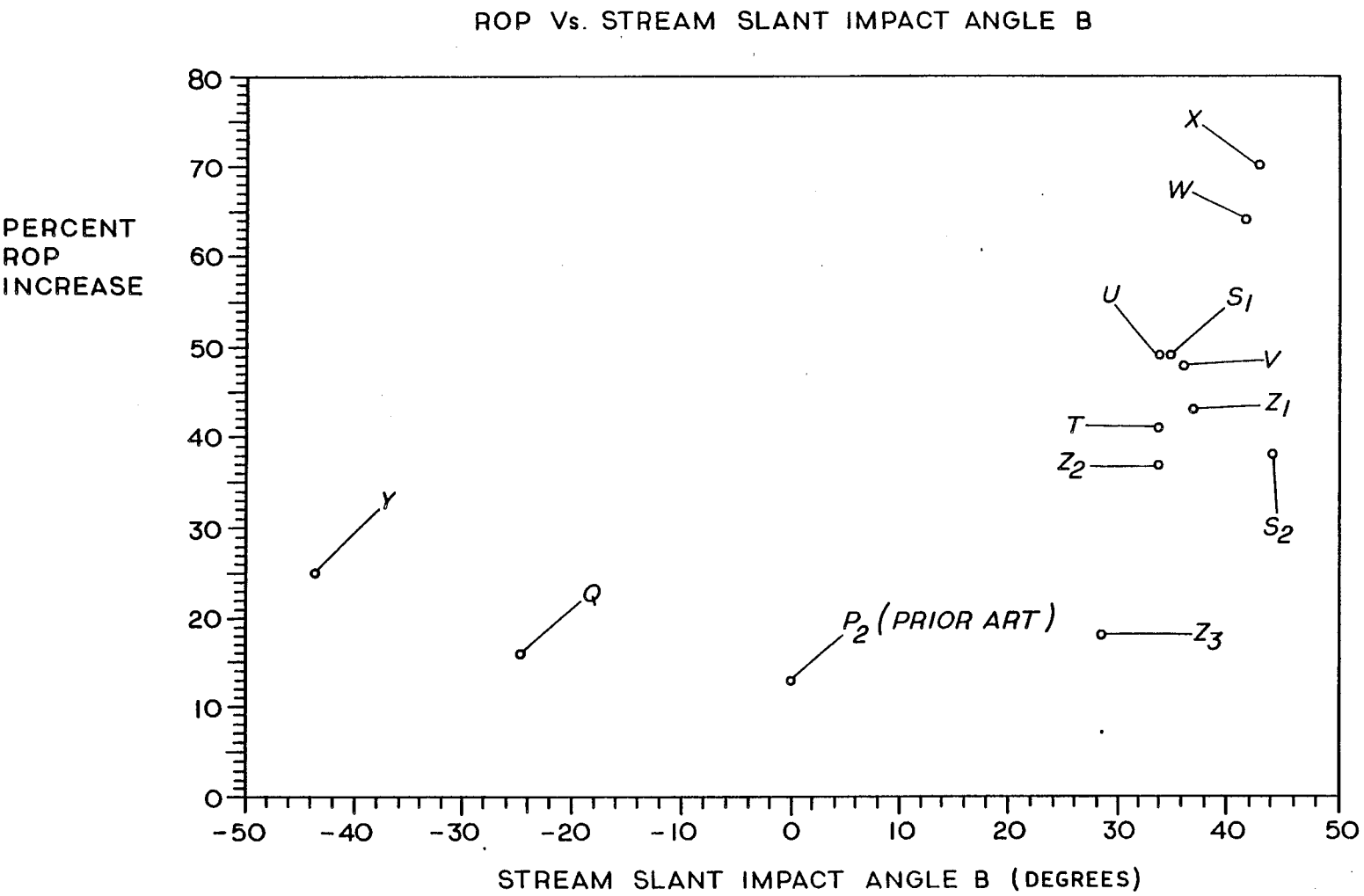
FIG. 14 is a graph comparing the rates of penetration for the various nozzle locations of this invention as a function of the slant impact angle of the fluid stream away from a radial position toward the side wall.

FIG. 14 is a graph illustrating the importance of the slant impact angle of the fluid stream against the side wall in obtaining an increased rate of penetration particularly as indicated by a cluster of the nozzle positions around a slant impact angle B against the side wall of around 40 degrees. Such a slant impact angle is desirable in order to provide a swirling action around the hole bottom to the high velocity fluid as it sweeps across the corner surface of the bore hole at the cutting engagement location of the gage row. It is believed that a slant impact angle B of at least 20 degrees is desirable in order to obtain substantial increased rates of penetration, but under certain conditions and formations a slant impact angle B of around 15 degrees might obtain such an increased rate of penetration. FIG. 13 illustrates the importance in improving penetration rates by controlling the distance D from point 48 to point 35 as shown in FIG. 5. As distance D1 decreases the penetration rate generally increases. It is highly desirable that the high velocity drilling fluid sweep across the corner surface as close as possible to the corner cutting engagement location of the gage row at point 35.

It was found that although cleaning the teeth and formation during cutting engagement was important, it was not desirable to entirely eliminate the cleaning action of the high velocity stream where it passed near the cutter prior to impacting the side wall. A portion of the stream energy may be utilized for cleaning the teeth prior to their engagement. Also, it may be desirable under certain conditions to direct more hydraulic energy or drilling fluid volume toward the gage row than toward the remaining rows. Due to the variation in drilling fluids solids content, flow velocities, and nozzle orifice diameters employed in various drilling operations, a compromise between tooth cleaning, erosion of the steel cutter body, and formation cleaning at cutting areas exists.

From the foregoing, it is apparent that an improved rate of penetration is provided by the improved cleaning and hydraulic action provided by the positioning of a high velocity stream of drilling fluid between a pair of adjacent roller cutters and slanting of such a stream toward the cutting elements in the gage row of one of the cutters. The stream is slanted outwardly toward the side wall at a slant impact angle B in a direction away from a radial direction in order to obtain the desired cleaning effect by the high velocity fluid in a sweeping and swirling action across the hole corner surface. The high velocity fluid impacts the side wall of the bore hole adjacent the cutting engagement locations of the cutting elements on the gage row for swirling around the hole corner surface and sweeping across the bottom surface of the bore hole to scour the formation at specific cutting engagement locations.

While preferred embodiments of the present invention have been illustrated, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A rotary drill bit for drilling a bore hole comprising:

a bit body having an upper end adapted to be connected to a drill string for rotating the bit and for delivering drill fluid to the bit, and having a plurality of legs extending from the lower end thereof, each leg including a journal on the extending end thereof having a longitudinal axis extending downwardly and generally radially inwardly of said leg;

a roller cutter mounted for rotation about the longitudinal axis of each journal and having a plurality of rows of cutting elements including an outer gage row;

said gage row of cutting elements adapted to cut the side wall of said well bore, the outer periphery of the bottom surface of said well bore, and the corner surface of said bore hole extending between said side wall and said outer periphery of said bottom surface; the remaining inner rows of cutting elements adapted to cut the remaining inner portion of said bottom surface; and a nozzle on said bit body positioned between a pair of adjacent roller cutters and having a nozzle orifice positioned closer to the bore hole side wall than to the axis of rotation of said bit at a height above the intersection of the longitudinal axes of said journals with said legs;

said nozzle orifice being constructed and positioned to accelerate and direct a high velocity stream of drilling fluid downwardly and outwardly, the center of the volume of said stream being directed toward an impact point on the side wall above the center of said corner surface such that the majority of the fluid sweeps first across said corner surface and then across said bottom surface;

said center of the volume of said stream being slanted for impacting said side wall at an impact angle greater than around fifteen (15) degrees away from a radial direction toward one of said adjacent cutters such that a substantial portion of the high velocity stream swirls around the corner surface toward said one cutter for scouring the formation at the lowermost cutting engagement contact location of the cutting elements in said gage row generally at said center of said corner surface.

2. A rotary drill bit as set forth in claim 1 wherein said high velocity fluid stream sweeps across a portion of said bottom surface to scour the formation at a majority of cutting engagement contact locations of said remaining inner rows of said adjacent cutter.

3. A rotary drill bit as set forth in claim 1 wherein said center of the volume of said high velocity stream sweeps across said center of said corner surface at a distance not greater than 0.42 inch per inch of bit diameter from the lowermost cutting engagement contact location of the cutting elements in said gage row at said center of said corner surface.

4. A rotary drill bit as set forth in claim 1 wherein said high velocity stream of drilling fluid is slanted against the direction of bit rotation toward the leading side of the trailing roller cutter of said pair of adjacent cutters with respect to the direction of rotation of said bit.

5. A rotary drill bit as set forth in claim 1 wherein said high velocity stream of drilling fluid is slanted in the direction of bit rotation toward the trailing side of the leading roller cutter of said pair of adjacent cutters with respect to the direction of rotation of said bit.

6. A rotary drill bit as set forth in claim 1 wherein said high velocity stream of drilling fluid is directed so that at least a side portion of said stream of drilling fluid contacts the cutting elements in said gage row prior to impacting said side wall.

7. A rotary drill bit for drilling a bore hole comprising:

a bit body having an upper end adapted to be connected to a drill string for rotating the bit and for delivering drill fluid to the bit, and having a plurality of legs extending from the lower end thereof, each leg including a journal on the extending end thereof having a longitudinal axis extending downwardly and generally radially inwardly of said leg;

a roller cutter mounted for rotation about the longitudinal axis of each journal and having a plurality of rows of cutting elements including an outer gage row;

said gage row of cutting elements adapted to cut the side wall of said well bore, the outer periphery of the bottom surface of said well bore, and the corner surface of said bore hole extending between said side wall and said outer periphery of said bottom surface; and a nozzle on said bit body positioned between a pair of adjacent roller cutters and having a nozzle orifice positioned closer to the bore hole side wall than to the axis of rotation of said bit at a height above the intersection of the longitudinal axes of said journals with said legs;

said nozzle orifice being constructed and positioned to direct a high velocity stream of drilling fluid downwardly and outwardly toward an impact point on the side wall above the center of said corner surface;

said center of the volume of said stream being slanted for impacting said side wall at an impact angle away from a radial direction toward one of said adjacent cutters to sweep across said center of said corner surface at a distance not greater than 0.42 inch per inch of bit diameter from the lowermost cutting engagement contact location of the cutting elements in said gage row at said center of said corner surface, such that a substantial portion of said high velocity stream sweeps across said corner at said contact location.

8. A rotary drill bit as set forth in claim 7 wherein said center of the volume of said high velocity stream impacts said side wall at a slant impact angle greater than around fifteen (15) degrees away from a radial direction.

9. A rotary drill bit as set forth in claim 7 wherein said high velocity stream of drilling fluid is slanted against the direction of bit rotation toward the leading side of the trailing roller cutter of said pair of adjacent cutters with respect to the direction of rotation of said bit.

10. A rotary drill bit as set forth in claim 7 wherein said high velocity stream of drilling fluid is slanted in the direction of bit rotation toward the trailing side of the leading roller cutter of said pair of adjacent cutters with respect to the direction of rotation of said bit

11. A rotary drill bit as set forth in claim 7 wherein said high velocity stream of drilling fluid is directed so that at least a side portion of said stream of drilling fluid contacts the cutting elements in said gage row prior to impacting said side wall.

12. A rotary drill bit for drilling a bore hole comprising:

a bit body having an upper end adapted to be connected to a drill string for rotating the bit and for delivering drill fluid to the bit, and having a plurality of legs extending from the lower end thereof, each leg including a journal on the extending end thereof having a longitudinal axis extending downwardly and generally radially inwardly of said leg;

a roller cutter mounted for rotation about the longitudinal axis of each journal and having a plurality of rows of cutting elements including an outer gage row;

said gage row of cutting elements adapted to cut the side wall of said well bore, the outer periphery of the bottom surface of said well bore, and the corner surface of said bore hole extending between said side wall and said outer periphery of said bottom surface; and a nozzle on said bit body positioned between a pair of adjacent roller cutters closer to the bore hole side wall than to the axis of rotation of said bit and having a nozzle orifice positioned at a height above the intersection of the longitudinal axes of said journals with said legs;

said nozzle orifice being constructed and positioned to direct a high velocity stream of drilling fluid downwardly and outwardly toward an impact point on the side wall such that a majority of the fluid sweeps first across said corner surface and then across said bottom surface;

said center of the volume of said stream being slanted toward one of said adjacent cutters to impact said side wall at a slant impact angle greater than around fifteen (15) degrees away from a radial direction such that a substantial portion of the high velocity stream swirls around the corner surface toward said one cutter for scouring the formation at the lowermost cutting engagement contact location of the cutting elements in said gage row at said center of said corner surface, said high velocity fluid stream further sweeping across a portion of said bottom surface to scour the formation at a majority of cutting engagement contact locations of rows other than said gage row of said one cutter.

13. A rotary drill bit as set forth in claim 12 wherein said high velocity stream of drilling fluid is slanted against the direction of bit rotation toward toward the leading side of the trailing roller cutter of said pair of adjacent cutters with respect to the direction of rotation of said bit.

14. A rotary drill bit as set forth in claim 12 wherein said high velocity stream of drilling fluid is slanted in the direction of bit rotation toward the trailing side of the leading roller cutter of said pair of adjacent cutters with respect to the direction of rotation of said bit.

15. A rotary drill bit as set forth in claim 12 wherein said high velocity stream of drilling fluid is directed so that at least a side portion of said stream of drilling fluid contacts the cutting elements in said gage row prior to impacting said side wall.

16. A rotary drill bit for drilling a bore hole comprising:

a bit body having an upper end adapted to be connected to a drill string for rotating the bit and for delivering drill fluid to the bit, and having three integrally connected legs extending from the lower end thereof, each leg including a generally cylindrical journal on the extending end thereof having a longitudinally axis extending downwardly and generally radially inwardly of said leg;

a roller cutter mounted for rotation about the longitudinal axis of each journal and having a plurality of rows of cutting elements including an outer gage row;

said gage row of cutting elements adapted to cut the side wall of said well bore, the outer periphery of the bottom surface of said well bore, and the corner surface of said bore hole extending between said side wall and said outer periphery of said bottom surface; and a nozzle on said bit body positioned between each pair of adjacent roller cutters, each nozzle having a nozzle orifice positioned closer to the bore hole side wall than to the axis of rotation of said bit at a height above the intersection of the longitudinal axis of said journal with said leg;

said nozzle orifice being positioned to direct a high velocity stream of drilling fluid downwardly and outwardly, the center of the volume of said stream being directed toward an impact point on the side wall above the center of said corner surface such that the majority of the fluid sweeps first across said corner surface and then across said bottom surface;

said center of the volume of said stream being slanted away from a radial direction at a slant impact angle of at least around fifteen (15) degrees against the direction of bit rotation toward the leading side of the trailing cutter of said pair of cutters for impacting said side wall so that a substantial portion of the high velocity stream swirls around the corner surface toward said trailing cutter for scouring the formation at the lowermost cutting engagement contact location of the cutting elements in said gage row generally at said center of said corner surface.

17. A rotary drill bit as set forth in claim 16 wherein the center of volume of said high velocity stream is slanted toward said trailing cutter away from a radial direction to impact said side wall at a slant impact angle between around 20 degrees and 50 degrees.

18. A rotary drill bit as set forth in claim 16 wherein said center of the volume of said high velocity stream sweeps across said center of said corner surface at a distance not greater than 0.42 inch per inch of bit diameter from the lowermost cutting engagement contact location of the cutting elements in said gage row at said center of said corner surface.

19. A rotary drill bit as set forth in claim 16 wherein the center of the volume of said high velocity stream is directed toward an impact point on said side wall between around ¼ inch and 3 inches above the lowermost cutting elements in said gage row.

20. A rotary drill bit for drilling a bore hole comprising:

a bit body having an upper end adapted to be connected to a drill string for rotating the bit and for delivering drill fluid to the bit, and having three integrally connected legs extending from the lower end thereof, each leg including a generally cylindrical journal on the extending end thereof having a longitudinal axis extending downwardly and generally radially inwardly of said leg;

a roller cutter mounted for rotation about the longitudinal axis of each journal and having a plurality of rows of cutting elements including an outer gage row;

said gage row of cutting elements adapted to cut the side wall of said well bore, the outer periphery of the bottom surface of said well bore, and the corner surface of said bore hole extending between said side wall and said outer periphery of said bottom surface; and a nozzle on said bit body positioned between each pair of adjacent roller cutters, each nozzle having a nozzle orifice positioned closer to the bore hole side wall than to the axis of rotation of said bit at a height above the intersection of the longitudinal axis of said journal with said leg;

said nozzle orifice positioned to direct a stream of drilling fluid downwardly and outwardly toward one of said pair of adjacent roller cutters, the center of the volume of said stream being slanted at a substantial angle away from a radial direction toward an impact point on the side wall above the center of said corner surface such that the majority of the fluid sweeps first across said corner surface toward said one cutter for scouring the formation thereat;

said center of the volume of said stream prior to impact against said side wall being spaced from the cutting elements in the gage row a distance not greater than 0.070 inch with more hydraulic energy being directed by said high velocity stream against the cutting elements in said gage row than against the cutting elements in any other row prior to impact of said stream against said side wall.

21. A rotary drill bit as set forth in claim 20 wherein the center of volume of said high velocity stream is slanted away from a radial direction to impact said side wall at a slant impact angle of at least around 15 degrees.

22. A rotary drill bit as set forth in claim 20 wherein the center of volume of said high velocity stream is slanted away from a radial direction to impact said side wall at a slant impact angle between around 20 degrees and 50 degrees.

23. A rotary drill bit as set forth in claim 20 wherein said center of the volume of said high velocity stream impacts said side wall at a height between around $\frac{1}{4}$ inch and 5 inches above the lowermost cutting elements in said gage row.

24. A rotary drill bit as set forth in claim 20 wherein said nozzle orifice is positioned at a location below the upper surface of said trailing roller cutter.

25. A rotary drill bit as set forth in claim 20 wherein said nozzle orifice is positioned generally centrally between said pair of adjacent cutters.

* * * * *